US007272077B2

(12) United States Patent
Nobs

(10) Patent No.: US 7,272,077 B2
(45) Date of Patent: Sep. 18, 2007

(54) WATCH WITH DIGITAL DISPLAY

(76) Inventor: Pierre Nobs, Im Blattacher 14, Wangen (CH)

( * ) Notice: Subject to any disclaimer, the term of this patent is extended or adjusted under 35 U.S.C. 154(b) by 263 days.

(21) Appl. No.: 10/718,154

(22) Filed: Nov. 20, 2003

(65) Prior Publication Data

US 2004/0100872 A1 May 27, 2004

(30) Foreign Application Priority Data

Nov. 22, 2002 (CH) ..... 1962/02

(51) Int. Cl.
*G04C 19/00* (2006.01)
*G04B 27/00* (2006.01)

(52) U.S. Cl. ..... 368/69; 368/82; 368/187; 368/321

(58) Field of Classification Search ..... 368/82, 368/189–190, 69, 206–216
See application file for complete search history.

(56) References Cited

U.S. PATENT DOCUMENTS 4,031,341 A * 6/1977 Wuthrich et al. ..... 200/52 R
4,115,993 A * 9/1978 Moriya ..... 368/72
4,283,784 A 8/1981 Horan
4,320,387 A 3/1982 Powell
4,334,280 A 6/1982 McDonald
4,354,260 A 10/1982 Planzo
4,395,134 A * 7/1983 Luce ..... 368/3
5,477,508 A * 12/1995 Will ..... 368/189
2001/0053109 A1* 12/2001 Ehrsam et al. ..... 368/190

FOREIGN PATENT DOCUMENTS

EP 0 698 983 A 2/1996
GB 2 028 547 A 3/1980
GB 2 156 111 A 10/1985

* cited by examiner

*Primary Examiner*—Vit Miska
*Assistant Examiner*—Sean Kayes
(74) *Attorney, Agent, or Firm*—Pearne & Gordon LLP

(57) ABSTRACT

Watch with digital display capable of being adjusted by a control device sensitive to rotation and to axial pressure. The watch comprises two lines of alphanumeric characters, of which one is used exclusively for displaying the current time and the other is used exclusively for displaying indications relative to auxiliary functions.

16 Claims, 3 Drawing Sheets

WATCH WITH DIGITAL DISPLAY

REFERENCE DATA

This application claims priority from Swiss patent application N. 2002CH-1962 filed on Nov. 22, 2002.

1. Field of the Invention

The present invention concerns a watch with digital display having a user interface allowing easy handling.

2. Description of Related Art

Most of the wristwatches of modern design offer a high number of specialized or auxiliary functions, such as display of a second time zone, alarm, chronograph, countdown and many others. In particular, electronic watches comprising a digital or alphanumeric display allow a near infinite variety of indications to be established and presented.

The auxiliary functions are generally accessible to the user by actuating one, two or several push buttons placed on the case body or integrated into the watch's winding crown and which enable to activate the different operating modes corresponding to the normal display and to the special functions.

It is also known to use, in particular in watches with an analog display, the rotation of the winding button to effect the selection of the special functions, additionally to the usual functions of time setting. The winding button usually exhibits various pulled positions allowing the hour and date to be adjusted and for acting on the special functions.

Use of the special functions is however difficult, because of the small size and limited number of the input devices that can reasonably be integrated in a wristwatch.

Taking into account the fact that most of the special functions also require the preliminary definition of parameters, for example of the waking time, of a second time zone or other, it is obvious that use of the watch often involves long sequences of actions on the push buttons and on the winding button, which are difficult to execute and remember.

The aforementioned limitation can be attenuated somewhat by multiplying the input devices, for example by providing the watch with several push buttons affected to special functions. There exist watches with four, five or even more push buttons and also watches comprising a miniaturized digital keyboard.

If this latter solution allows the command sequences to be simplified, it remains tedious for the user who must learn and remember the functions of each push button. Furthermore, the limited space available results in the size of the input devices being extremely reduced, which makes the handling even more difficult. Finally, this solution means a higher production cost because of the greater number of required elements and is not aesthetically pleasing to everyone.

BRIEF SUMMARY OF THE INVENTION

It is thus an aim of the present invention to propose a watch that can be used easily and intuitively, without having the limitations of the prior art.

It is another aim of the present invention to propose a watch having a user interface that is simple and easy to learn and remember.

It is another aim of the present invention to propose a watch having a reduced number of input devices.

These aims stated here above are achieved by a device having the characteristics of the independent claim 1 and by a method having the characteristics of the independent claim 12, preferred embodiments of the system comprising the characteristics of the dependent claims. In particular, the invention concerns a digital watch with a digital display, said display being constituted by a first line of alphanumeric characters and by a second line of alphanumeric characters, said watch further comprising control means for keeping and displaying the current time on said digital display and a roller sensitive to axial pressure and to the rotation around its axis.

BRIEF DESCRIPTION OF THE DRAWINGS

The present invention will be better understood with the aid of the figures and of the examples illustrating by way of explaining but non-limiting example an embodiment of the distributor according to the invention.

DETAILED DESCRIPTION OF THE INVENTION

Figure 1:
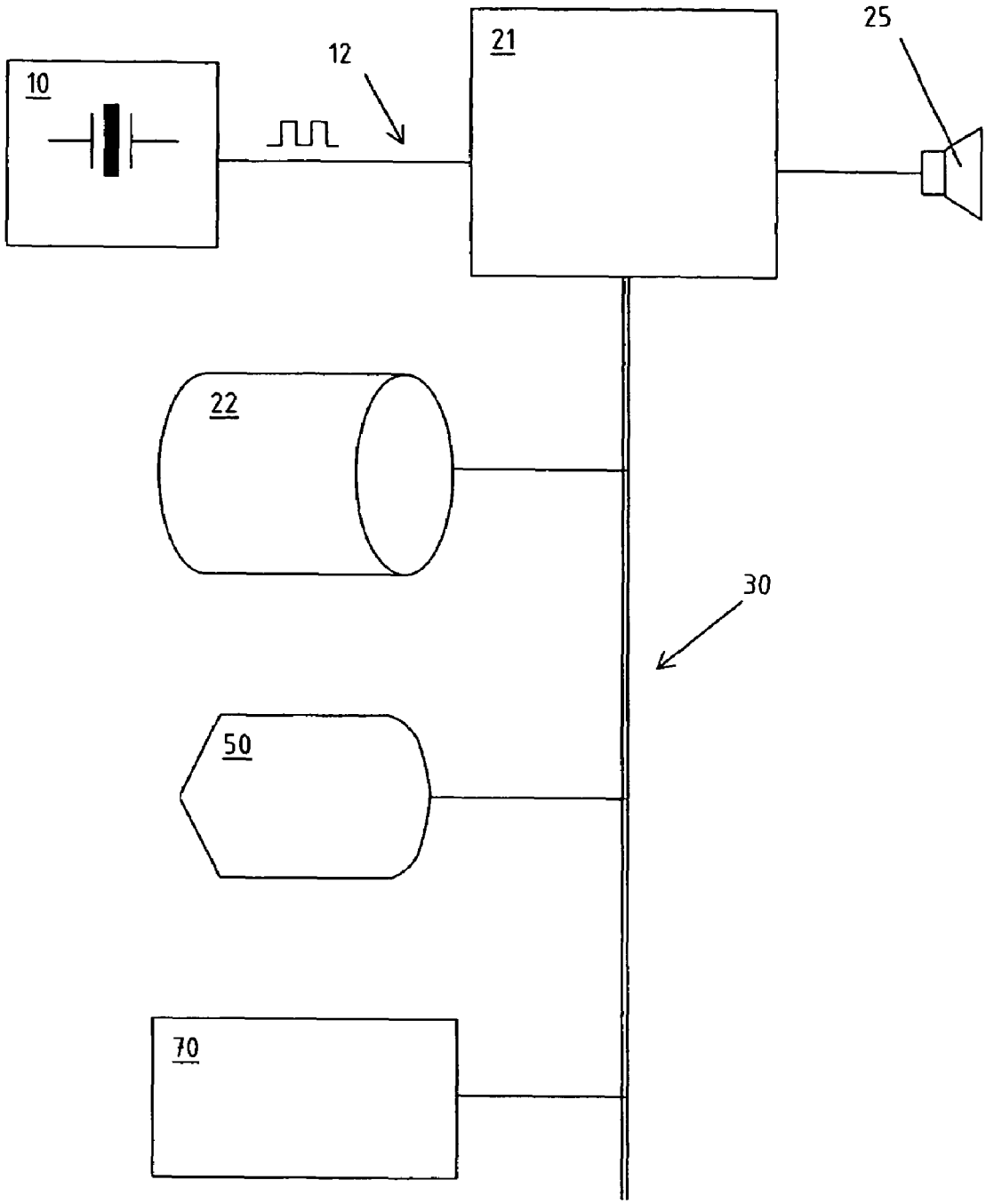
FIG. 1 shows diagrammatically the operating principle of a watch according to the invention.
Figure 2A:
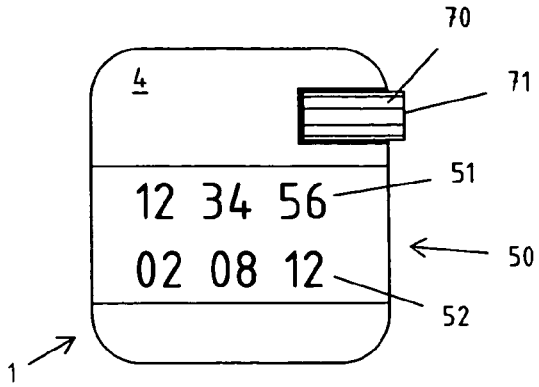
FIGS. 2*a* to 2*e* show the state of the display of a watch according to the invention in its normal operating mode and in the modes "second time zone", "alarm", "chronograph" and "countdown" respectively.
Figure 2D:
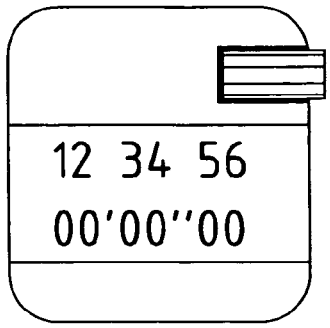
Figure 2B:
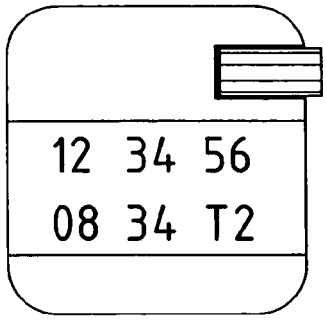

FIG. 1 describes the operation diagram of a wristwatch 1 according to the invention. The watch is provided with a movement for digital watches, comprised of a quartz oscillator 10 supplying an electric signal of constant frequency, used as time base 12 for a microprocessor 21 whose working rate is rigorously synchronous to the time base 12. A permanent memory 22 in ROM or FLASH-RAM technology stores a program for the microprocessor 21 comprising a software for counting the pulses from the time base, computing the time and date and displaying them on an alphanumeric LCD 50, consisting of two lines 1, 52 of six alphanumeric characters each, as is more clearly visible in FIG. 2*a*. The microprocessor 21 executing the program stored in the memory 22 is thus a control means for keeping and displaying the current time on the digital display 50.

The diagram described in FIG. 1 is only given as an indication and does not constitute a limitation of the invention, which also comprises equivalent devices in which all or certain of the functions are implemented by other control means, for example a dedicated logic integrated circuit ASIC (Application-Specific Integrated Circuit) or a programmable logic integrated circuit FPGA (Field Programmable Gate Array) or any other equivalent.

This example should also not be interpreted in the sense that a watch according to the invention is limited to a display constituted exclusively of the two aforementioned lines of alphanumeric characters. On the contrary, the invention also includes watches whose display can also display other than non-alphanumerical symbols graphical symbols.

The memory 22 also comprises software for effecting the time setting and date setting of the watch 1. To this effect, the watch 1 also comprises an input device in the form of a roller 70 (see FIGS. 1 and 2*a*), sensitive to axial pressure and to rotation around its axis, through which the user can effect all time and date setting operations.

The roller 70 is connected to the microprocessor 21 through the communication bus 30 or through dedicated entry lines, so that the microprocessor can detect the rotation of the roller 70 in one direction or the other or an axial pressure on the roller 70.

The roller 70 is placed on the front side 4 of the watch so as to leave at least one sector of its lateral surface accessible, in order that the roller 70 can be turned upwards or downwards with the finger tip. The roller 70 can preferably be turned in discrete stages that are multiples of a predetermined angle and corresponding to stable positions of the roller. The resistance offered by the roller 70 to rotation is modulated accordingly and provides the user with a tactile response.

The position of the roller 70 is specified here by way of example only. The roller 70 could, according to circumstances and to the maker's choice, also assume different positions and orientations.

An extremity 71 of the roller 70 protrudes slightly over the side of the watchcase 1 to allow the user to exert an axial pressure. The microprocessor 21 is programmed to distinguish between a short pressure and a prolonged pressure on the roller 70, a prolonged pressure being a pressure held for a length of time greater than a predetermined interval, for example a second.

Figure 3:
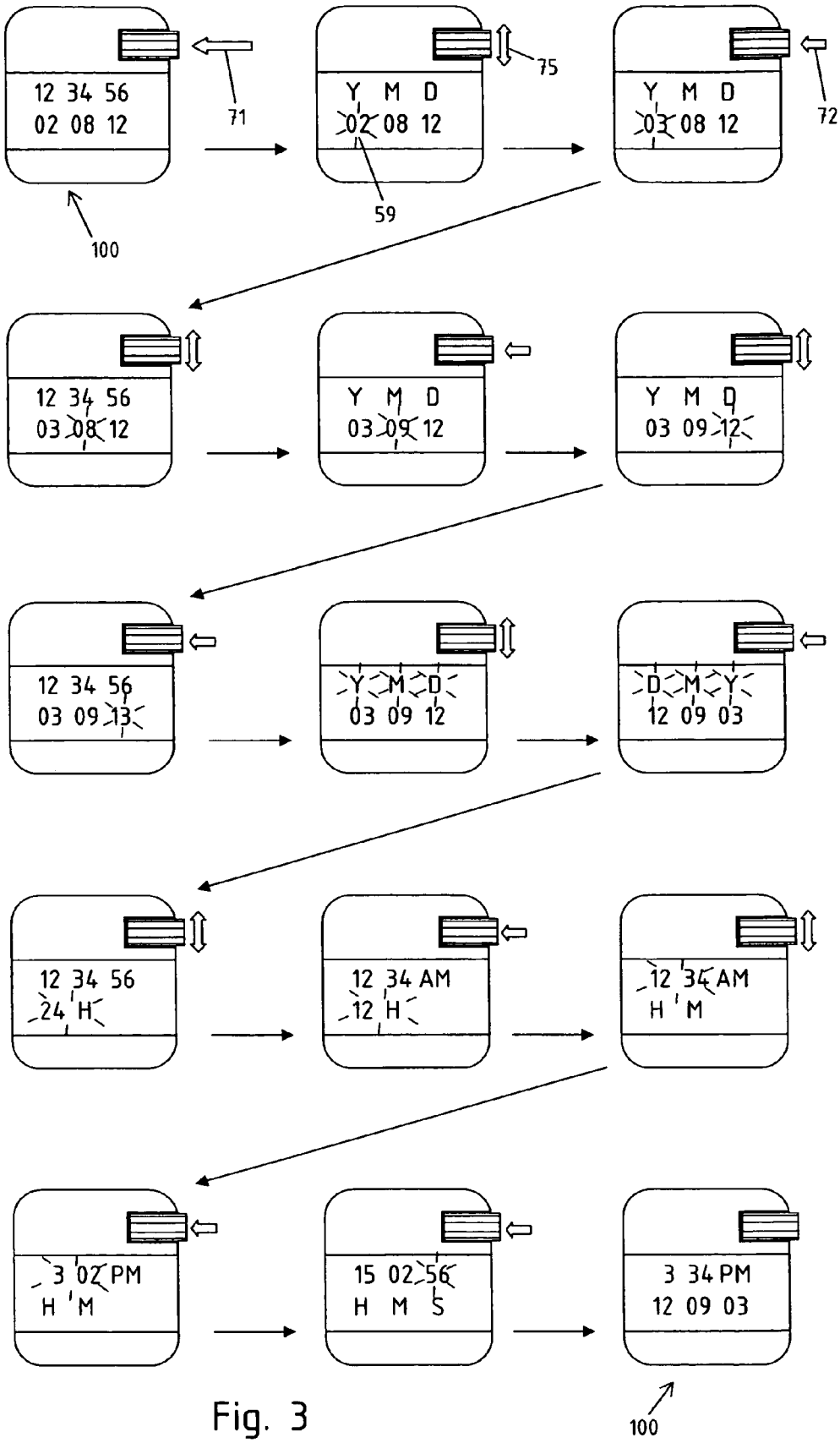
FIG. 3 shows the steps of a subsidiary date setting and time setting mode of a watch according to the invention.

In order to avoid involuntary manipulations, the watch's software provides a separate subsidiary mode for adjusting the date and time, the steps whereof are visible in FIG. 3 and in table 2. The subsidiary date and time setting mode is activated by a prolonged pressure 71 on the roller 70 when the watch is in its normal operating mode 100 and is signaled by an acoustic signal emitted by the transducer 25.

The first step for adjusting the date comprises the definition of the current year, signaled by the blinking 59 of corresponding numbers in the display 50, through the rotation 75 of the roller 70 upwards or downwards for incrementing resp. decrementing. Once the wished indication is obtained, a short pressure 72 on the roller allows to confirm the entry and to move on to the next step, which is the definition of the month.

The next steps unfold in an essentially identical manner: each element to be defined is indicated by blinking of the corresponding element on the display 5. The definition is effected by rotating the roller 70 and is then confirmed by a short pressure on the roller 70. It will be appreciated that logically equivalent operations are performed by the same action on the roller, in a coherent fashion, so that use is intuitive and easy to remember.

The memory 22 also comprises software for implementing the auxiliary functions of second time zone, alarm, chronograph and countdown. The number and nature of the auxiliary functions are specified here by way of example only. A watch according to the invention could very well provide a lower or higher number of functions or functions that are different.

Figure 2E:
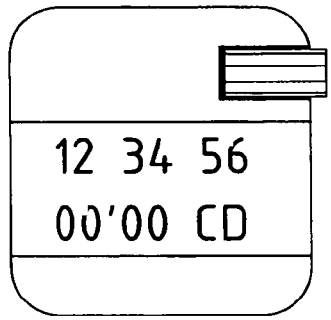
Figure 2C:
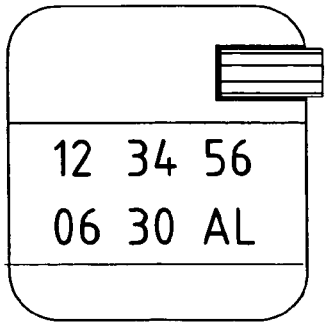

Each function is associated to an operating mode of the watch, in which the lower display line 52 bears indications relative to the selected auxiliary function. The upper display line 51, on the other hand, always and exclusively indicates the time. FIGS. 2*a*, 2*b*, 2*c*, 2*d*, 2*e* show the state of the display 50 for the normal operating mode and for the operating modes corresponding to the auxiliary functions of second time zone (FIG. 2*b*), alarm (FIG. 2*c*), chronograph (FIG. 2*d*) and countdown (FIG. 2*e*).

It will be appreciated how each operating mode can immediately be distinguished from the others by means of information displayed on the lower display line 52.

The auxiliary functions can be activated cyclically by rotating the roller 71, as can be seen in table 1.

Most of the auxiliary functions require a preliminary definition of the parameters such as for example: alarm time; difference between local time and that of second time zone; duration of countdown. In this case, the corresponding operating modes also provide a subsidiary definition mode that is activated with a prolonged pressure on the roller 70 in a manner similar to the subsidiary date and time setting described here above. The steps of the subsidiary definition mode corresponding to the different functions are described in tables 2, 3, 4 and 5.

Figure 2F:
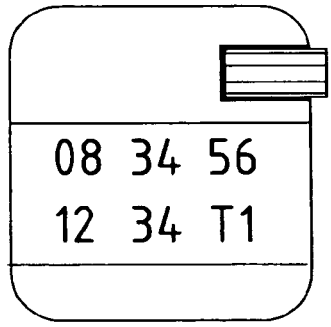
FIG. 2*f* shows a second display option of a watch according to the invention in the mode "second time zone"

The function "time zone" also offers a second display option in which the positions of the time indicated for the second time zone and for the main time zone are switched, as can be seen in FIG. 2*f*. This display option, which is activated by axial pressure on the roller 70, is used when the user is travelling in the time zone T2 different from the time zone T1. The switch is signaled by the indication "T1" in the lower line 52.

By opportunely activating the second display option, the upper line 51 of the display always indicates the current time, which is coherent with the watch's operating principle. Furthermore, the alarm function continues to work correctly according to the local hour, as is logical, with the acoustic alarm signal being triggered when the local time is equal to the predefined alarm time. The date indication is also coherent with local time and is incremented at the local midnight.

This function is specially designed for users who regularly travel between two different time zones and who can thus, at each trip, adjust their watch to local time by simply pressing on the roller 70, thus switching the positions of T1 and T2 without having to make any changes to the alarm definition.

Even if this embodiment provides only a second time zone T2, the invention is not limited to this. It is obvious that one could have several "time zone" functions to simultaneously keep the time of plurality of zones T2, T3, T4 etc. The user could thus easily select the time zone corresponding to the local time during a trip comprising several stages in different time zones. Each of these functions could also provide a second display option to display the local time on the first display line 51 and to modify the working of the alarm and of the calendar, in a manner totally similar to that described here above for T2.

The watch according to this embodiment of the invention presents as only entry device the roller 70, on which the user can act by rotation or by pressure. It will be observed how actions on the roller 70 always produce equivalent results in all the subsidiary definition modes. The resulting user interface is intuitive and easy to remember.

Because the roller 70 is the only entry device of the watch, it can be of relatively large size. Thanks to its size and its easily accessible position, the roller 70 is much easier to handle than traditional entry devices.

The watch's display is characterized by the two lines 51 and 52 of alphanumeric characters, the first of which being used only for displaying the current time and the second for displaying indications relative to the auxiliary functions. Thanks to this disposition, it is possible to achieve a rational and intuitive division between the current time, always available on the fist line, and the functions, displayed by the second display line.

TABLE 1

Operating modes:

| Operating mode | Action on the roller 70 | Result |
|---|---|---|
| Standard display | Prolonged pressure | Auxiliary mode adjust date/time |
| | Short pressure | Indication of seconds yes/no |
| | Upward rotation | Switch to CD mode |
| | Downward rotation | Switch to T2 mode |
| Time zone (T2) | Prolonged pressure | Auxiliary mode define T2 |
| | Short pressure | Switch T1/T2 |
| | Upward rotation | Switch to standard mode |
| | Downward rotation | Switch to AL mode |
| Alarm (AL) | Prolonged pressure | Auxiliary mode define AL |
| | Short pressure | Alarm on/off |
| | Upward rotation | Switch to T2mode |
| | Downward rotation | Switch to chronograph mode |
| Chronograph | Prolonged pressure | Reset to zero |
| | Short pressure | On/off |
| | Upward rotation | Switch to AL mode |
| | Downward rotation | Switch to CD mode |
| Countdown (CD) | Prolonged pressure | Auxiliary mode define CD |
| | Short pressure | On/off |
| | Upward rotation | Switch to chronograph mode |
| | Downward rotation | Switch to standard mode |

TABLE 2 auxiliary mode adjust date/time

| Action | Result |
|---|---|
| Watch initially in mode | <<standard display>> |
| Prolonged pressure | Year selected (blinking) |
| Upw./downw.rotation | Define year |
| Short pressure | Month selected |
| Upw./downw.rotation | Define month |
| Short pressure | Day selected |
| Upw./downw.rotation | Define day |
| Short pressure | Upper line selected |
| Upw./downw.rotation | Choice date format: <<YMD>>/<<DMY>>/<<MDY>> |
| Short pressure | Lower line selected |
| Upw./downw.rotation | Choice time format: 24 H/12 H |
| Short pressure | Hour and minutes selected |
| Upw./downw.rotation | Define hour and minutes |
| Short pressure | Seconds selected |
| Short pressure | Reset to zero of seconds |
| Watch returns to initial mode | <<standard display>> |

TABLE 3

Auxiliary mode define T2

| Action | Resultat |
|---|---|
| Watch initially in mode | <<T2>> |
| Prolonged pressure | Time T2 (lower line) selected |
| Upw./downw.rotation | Define time T2 |
| Short pressure | Confirmation |
| Watch returns to initial mode | <<T2>> |

TABLE 4

Auxiliary mode define AL

| Action | Resultat |
|---|---|
| Watch initially in mode | <<AL>> |
| Prolonged pressure | Alarm time selected |
| Upw./downw.rotation | Define alarm time |
| Short pressure | Confirmation |
| Watch returns to initial mode | <<AL>> |

TABLE 5

Auxiliary mode define CD

| Action | Result |
|---|---|
| Watch initially in mode | <<CD>> |
| Prolonged pressure | Duration selected |
| Upw./downw.rotation | Define duration |
| Short pressure | Confirmation |
| Watch returns to initial mode | <<CD>> |

The invention claimed is:

1. Digital watch, comprising a face side having a digital display, said display comprising a first line of alphanumeric characters and a second line of alphanumeric characters, said watch further comprising control means for keeping and displaying the current time on said digital display and an interface device sensitive to rotation around its axis and to a pressure along the direction of its rotational axis, and connected to said control means, said interface device having a lateral surface, at least one sector of the lateral surface being accessible and protruding from said face side for allowing the rotation of the interface device.

2. Digital watch according to the claim 1, wherein said control means are arranged to supply a plurality of functions and wherein the current time is always displayed on said first line of alphanumeric characters and the indications relative to said functions are optionally displayed on said second line of alphanumeric characters.

3. Digital watch according to claim 2, wherein said functions comprise a standard display mode and at least one additional mode from among: calendar, alarm, countdown, second time zone and chronograph.

4. Digital watch according to claim 3, comprising at least one time zone function for keeping and displaying the time of an auxiliary time zone and the time of a main time zone, wherein said time zone function comprises a second display option wherein said time of an auxiliary time zone is displayed on said first line of alphanumeric characters and said time of a main time zone is displayed on said second line of alphanumeric characters.

5. Digital watch according to claim 4, comprising an alarm function, wherein the alarm is triggered according to said time of a main time zone when said second display zone is inactive and the alarm is triggered according to said time of an auxiliary time zone when said second display option is active.

6. Digital watch according to claim 2, wherein all the parameter definitions and the function selection are performed only by rotation and pressure of said interface device.

7. Digital watch according to claim 1, wherein said control means are capable of discriminating between a short pressure and a prolonged pressure on said interface device.

8. Digital watch according to claim 1, wherein said display can also display other non-alphanumerical graphical symbols.

9. Digital watch, comprising a face side having a digital display, said display comprising a first line of alphanumeric characters and a second line of alphanumeric characters, said watch further comprising control means for keeping and displaying the current time on said digital display and a roller sensitive to rotation around its axis and to a pressure along the direction of its rotational axis, and connected to said control means, wherein said roller is capable of turning around its axis, said roller having at least one sector of its lateral surface accessible and protruding from said face side for allowing the rotation around the axis of the roller to be communicated with a finger tip, said roller having an extremity accessible for allowing pressure along the direction of its rotation axis to be exerted with a finger tip.

10. Digital watch, comprising a face side having a digital display, said display comprising a first line of alphanumeric characters and a second line of alphanumeric characters, said watch further comprising control means for keeping and displaying the current time on said digital display and a roller sensitive to rotation around its axis and to a pressure along the direction of its rotational axis, and connected to said control means, wherein said roller is fastened on the face side of said watch, so as to be capable of turning around its axis, said roller having at least one sector of its lateral surface accessible and protruding from said face side for allowing the rotation around the axis of the roller to be communicated with a finger tip, said roller having an extremity accessible for allowing pressure along the direction of its rotation axis to be exerted with a finger tip.

11. Method of management and control of a watch according to claim 2, comprising the steps of:

reacting to the rotation of said interface device by selecting in a cyclical fashion an operating mode from among a set of operating modes, each of said operating modes corresponding to one of said functions supplied by the control module;

displaying the indications relative to the function corresponding to the selected operating mode on said second line of alphanumeric characters.

12. Method according to claim 11, wherein at least one of said operating modes comprises a subsidiary definition mode and reacts to pressure exerted on said interface device by activating said subsidiary definition mode.

13. Method according to claim 12, wherein said at least one operating mode comprising a subsidiary definition mode reacts to a prolonged pressure exerted on said interface device by activating said subsidiary definition mode.

14. Method according to claim 11, wherein at least one of said operating modes is adapted for keeping and displaying the time of an auxiliary time zone and the time of a main time zone and reacts to pressure exerted on said interface device by activating a second display option, in which said time of an auxiliary time zone is displayed on said first line of alphanumeric characters and said time of a main time zone is displayed on said second line of alphanumeric characters.

15. Method according to claim 14, wherein one of said operating modes is an alarm mode for triggering an acoustic signal at a predetermined alarm time, wherein said signal is triggered according to said time of a main time zone when said second display option is inactive and said signal is triggered according to said time of an auxiliary time zone when said second display option is active.

16. Computer program product, comprising a computer program stored in the memory of a digital processor, comprising software portions for performing the method of claim 11 when it is executed on said digital processor.

* * * * *